United States Patent [19]

Grisel

[11] 4,059,209

[45] Nov. 22, 1977

[54] CARRIER AND LOCK FOR SKI EQUIPMENT

[75] Inventor: Byron Lynn Grisel, Wasilla, Alaska

[73] Assignee: Grizzley Ski Lock Corporation, Salt Lake City, Utah

[21] Appl. No.: 701,590

[22] Filed: July 1, 1976

[51] Int. Cl.[2] ..... B65D 69/00

[52] U.S. Cl. ..... 224/45 S; 280/11.37 K; 70/58; 248/222.1; 248/224.3; 211/60 SK

[58] Field of Search ..... 224/45 S, 45 R, 5 Z, 224/5 R; 280/11.37 K, 11.37 A; 70/58; 24/73 SG, 81 SK; 211/60 SK; 248/222.1, 224.3

[56] References Cited

U.S. PATENT DOCUMENTS

| | | | |
|---|---|---|---|
| 3,685,667 | 8/1972 | Bell | 224/45 S X |
| 3,797,284 | 3/1974 | Grossman | 70/58 |
| 3,909,031 | 9/1975 | Schmaedeke et al. | 224/45 S X |

*Primary Examiner*—Robert J. Spar
*Assistant Examiner*—Donald W. Underwood
*Attorney, Agent, or Firm*—B. Deon Criddle

[57] ABSTRACT

A carrier and lock for skis and ski poles. The device of the invention comprises a housing made up of two side frames interconnected by a clamshell hinge. The side frames are opened to provide ski-locking means and a handle which may be integral with the hinge, and are recessed to allow positioning of skis and poles therebetween. Resilient surfaces in the recesses tightly engage the skis and poles. Locking members carried by the side frames telescope with respect to receiving members and may be locked thereto to prevent theft of the device and the skis and poles secured therein.

10 Claims, 5 Drawing Figures

CARRIER AND LOCK FOR SKI EQUIPMENT

BRIEF DESCRIPTION OF THE INVENTION

1. Field of the Invention

This invention relates to devices used by skiers in the carrying of their skis and poles and to devices used to secure such equipment against theft when it is not in use.

2. Prior Art

The carrying and handling of ski equipment has long presented problems to skiers. The length and weight of such equipment, coupled with the number of pieces that are employed, frequently results in people being injured as skis are swung, dropped, or twisted as a skier attempts to transport his equipment to or from a ski slope. At best, the skis and poles, when carried loosely, are unwieldy and very difficult to handle.

Skis and poles, may also be very expensive pieces of equipment, and it is frequently desirable to be able to lock them against theft when they are not in use. For example, a skier going into a crowded lodge, cannot carry his skis and poles inside with him and may be forced to leave them outside. If he is not able to secure them, he faces a very real possibility that they will be stolen before he can return. Not only does this cause an economic loss, but it also is a great inconvenience, when planning to ski, not to have skis and poles available for the purpose.

In the past, there have been a number of carriers and carrier-lock units developed. Some of these are quite convenient, and provide an acceptable way of organizing and carrying skis and poles, and those that have locks, generally provide that they can be attached to various kinds of rigid structures. However, so far as I am aware, there has not heretofore been presented a carrier that can be made out of minimum number of parts and that can be locked to a special low cost rack that can be easily attached to a building or other fixed structure.

U.S. Pat. No. 3,892,343, for example, shows a ski-tote device that is adapted to clamp skis and poles between hinge clamping members and that includes handles to facilitate carrying thereof, but does not teach any means for locking the assembly to a fixed structure. U.S. Pat. Nos. 3,307,759, 3,568,902, and 3,830,416, all show various types of ski carriers and U.S. Pat. No. 3,568,902, further provides for the carrying of poles along with the skis, and each of the carriers disclosed include some means for locking the carrier and equipment carried thereby to a fixed structure. However, these devices like the ski equipment carrier shown in U.S. Pat. No. 3,935,977, which is disclosed as including a pair of hingedly interconnected polygonal cover segments in which the skis and poles are fitted, include cables or chains as a means for locking the devices in place and these components, like the skis and poles themselves, are often difficult to handle.

SUMMARY OF THE INVENTION

Principal features of the present invention are to provide a ski carrier and lock that is economical to produce, that will allow for the simultaneous carrying of a pair of skis and a pair of ski poles, and that includes a compact locking arrangement that will allow such carrier to be easily and neatly secured to a low cost rack that is permanently mounted to a fixed structure, such as a building.

Principal features of the invention include a pair of side frames, hinged together and arranged to open and close in clamshell fashion. The hinge interconnecting the frames is part of a handle for the carrier and the frames are each recessed to allow for positioning of skis and poles therebetween. Resilient surfaces inside the recessed portions securely clamp the skis and poles, without damaging them. A locking member is fixed to each frame to telescopingly engage a receiving member of a rack, and at least one of the cooperating locking and receiving members has a lock arrangement, such that the carrier can be secured to the rack.

The side frames are open to allow portions thereof to serve as the carrier handle and to keep skis from sliding out ends of the carrier.

Additional objects and features of the invention will become apparent from the following detailed description, taken together with the accompanying drawing.

THE DRAWING

In the drawing:

FIG. 1 is a perspective view of the ski equipment carrier of the invention;

FIG. 2, a perspective view of a portion of a rack to which the carrier of FIG. 1 is secured;

FIG. 3, an end elevation view of the carrier;

FIG. 4, a perspective view of the carrier with a pair of skis and a pair of ski poles positioned therein; and FIG. 5, a view like that of FIG. 2, but showing another embodiment of the rack.

DETAILED DESCRIPTION

Figure 1:
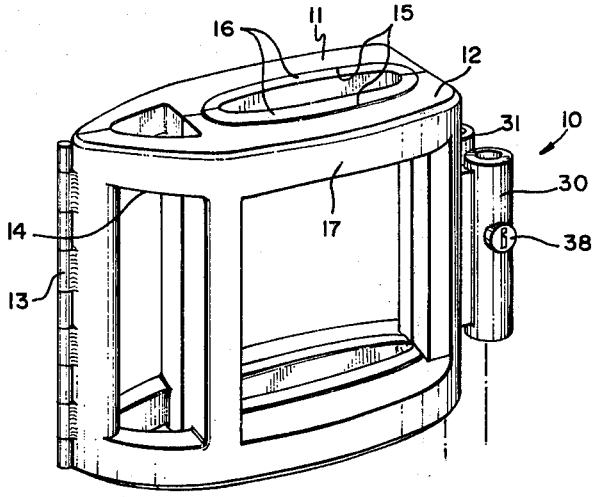

Referring now to the drawings:

In the illustrated preferred embodiment, the ski carrier of the invention, shown generally at 10, includes a pair of side frames 11 and 12 that are hingedly interconnected at 13. The frames each have generally arcuately shaped outer surfaces and they are arranged to be pivoted together in clamshell-type fashion. Each frame member is provided with an opening 14 a spaced distance from the hinge connection 13, so that a user's hand can be inserted through the openings 14 when the frame members are clamped together. In addition, each frame member is recessed, as shown at 15, to allow for positioning of a pair of skis and a pair of ski poles between the frame members, when the frame members are clamped together.

Resilient strips 16 are provided as linings inside each recess 15 to securely grip, without damaging, the ski equipment positioned within the recesses. The resilient strips 16 may be formed of rubber, soft plastic or the like, and may be adhesively bonded to the frame members, attached in any other conventional and accepted way, or may be formed integral with the frame members.

Figure 4:
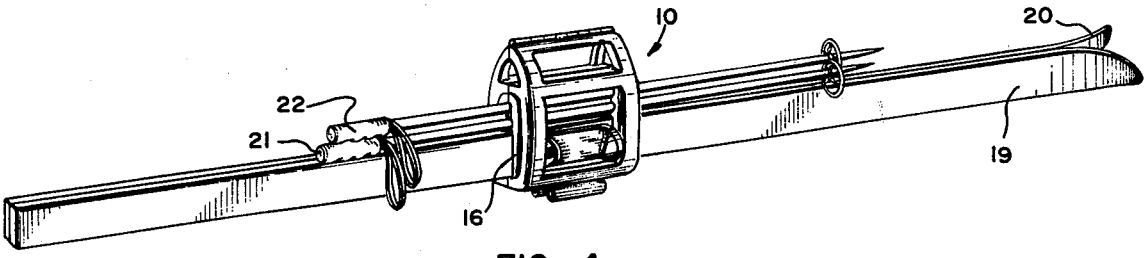

The sidewalls of the frame members are provided with openings 17 arranged such that when a pair of skis are placed running surface to running surface within the carrier and projecting through the recesses 15, the bindings on the skis will project through the openings 17, as shown in FIG. 4. The bindings will then engage the frames 11 and 12 should any attempt be made to slide the skis through ends of the frames. As shown best in FIG. 4, the carrier clamps the skis 19 and 20 and a pair of poles 21 and 22 such that they are tightly gripped by the resilient members 16 and such that they are frictionally held against sliding with respect to the carrier. The bindings on the skis then further cooperate with the frame members to prevent sliding of the skis with respect to the carrier and the baskets and handles on the poles will engage the carrier to keep the poles from being slipped through the carrier.

Figure 3:
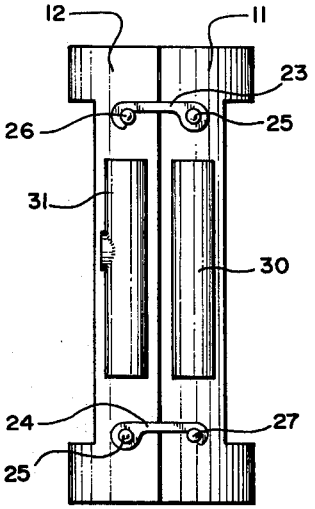

As shown best in FIG. 3, pivoted latches 23 and 24, each pivotally connected at 25 to one of the frame members 11 and 12 hook over catches 26 and 27 on the opposite frame members to securely clamp the frame members 11 and 12 together.

Figure 2:
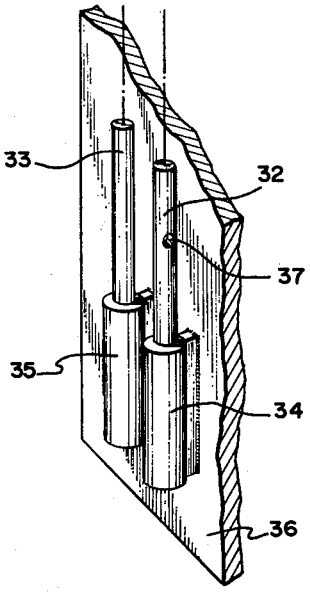

As shown best in FIGS. 1 and 2, tubular locking members 31 and 32 are respectively attached to the frame members 11 and 12. The locking members are arranged to be parallel to one another and telescope over receiving members in the form of receiving posts 32 and 33 that project upwardly from mounts 34 and 35 that are attached to a backing member 36. The backing member may constitute a board or other rigid material that is adapted to be permanently mounted to a building wall or other such structure, or it may constitute the building wall itself. Receiving post 32 has a hole 37 therethrough that is adapted to receive a bar of a lock 38 that is mounted within the wall of the tubular member 30. Thus, when the tubular locking members 30 and 31 are telescoped over the receiving posts 32 and 33, and the lock 38 is operated to position the bar thereof through the hole 37, the carrier 10 is securely locked to the member 36. So locked, the carrier 10 and the skis 19 and 20 and the poles 21 and 22 clamped therein are securely locked in place and can be removed only by proper operation of the lock 38, or by severely damaging the carrier and/or poles and skis. While the tubular locking members 30 and 31 are shown in FIG. 1 as having a circular interior cross section, to match the circular cross section of the receiving posts 32 and 33, it will be apparent that other interior configurations of the tubular members and corresponding post shapes can be used.

Figure 5:
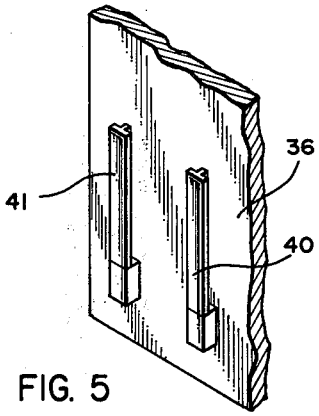

In FIG. 5, there is shown another preferred shape of the receiving posts on which the tubular members affixed to the frames 11 and 12 are adapted to be positioned and locked. While not shown, it will be apparent that the tubular locking members telescopingly cooperating with the T-shaped posts 40 and 41 of FIG. 5, would have a corresponding T-shaped interior cross section and that the bar of the lock 38 would project into a hole provided therefor in a portion of one of the posts.

It will also be apparent that although the tubular locking members are illustrated as being mounted to the frame members of carrier 10, with the tubular members being adapted to telescope over receiving posts, it is entirely possible for the tubular members and the receiving post to be reversed such that receiving posts carried by the carrier will telescope into tubular members affixed to the member 36.

Although preferred forms of my invention have been herein disclosed, it is to be understood that the present disclosure is made by way of example and that variations are possible, without departing from the scope of the hereinafter claimed subject matter, which subject matter I regard as my invention.

I claim:

1. A carrier and lock for ski equipment comprising
a pair of side frames, each having opposite ends;
hinge means connecting said side frames to open and close in clamshell fashion;
an elongate handle formed by said side frames, said handle being at the same end of said side frames as the hinge means;
opposed recesses in the side frames, said recesses being arranged to receive a pair of skis and a pair of ski poles therein when said skis and poles are clamped between said side frames;
means to releasably latch the side frames together, with a pair of skis and a pair of ski poles clamped therebetween;
a locking member on each side frame, at the end thereof opposite to the hinge, said locking members being arranged to slidably engage first and second receiving members, respectively; and
a lock means carried by the locking member on one said side frame for securing said last mentioned locking member to said first receiving member, whereby the other said side frame is held clamped to said one side frame by the engagement of its locking member with said second receiving member.

2. A carrier and lock as in claim 1, further including
a resilient lining inside each recess, said lining frictionally holding skis and ski poles placed in the recesses and protecting said skis and poles against damage.

3. A carrier and lock as in claim 2, wherein
the locking members are each adapted to telescopingly couple with a receiving member.

4. A carrier and lock as in claim 3, wherein
the locking members are tubular.

5. A carrier and lock as in claim 4, wherein
the locking members are of generally circular interior configuration.

6. A carrier and lock as in claim 4, wherein
the locking members are of generally T-shaped interior configuration.

7. A carrier and lock as in claim 4, further including
receiving members comprising posts adapted to be telescopingly coupled to the locking members.

8. A carrier and lock as in claim 7, wherein
the posts project from fixed bases and have a cross-sectional configuration of the same shape as that of the interiors of the locking members.

9. A carrier and lock as in claim 8, wherein
the locking members are of generally circular interior configuration.

10. A carrier and lock as in claim 8, wherein
the locking members are of generally T-shaped interior configuration.

* * * * *